US008931381B2

(12) United States Patent
Poran

(10) Patent No.: US 8,931,381 B2
(45) Date of Patent: Jan. 13, 2015

(54) METHOD AND SYSTEM FOR TRAINING A USER TO CORRECTLY USE A KNIFE

(71) Applicant: David Alan Poran, Front Royal, VA (US)

(72) Inventor: David Alan Poran, Front Royal, VA (US)

( * ) Notice: Subject to any disclaimer, the term of this patent is extended or adjusted under 35 U.S.C. 154(b) by 189 days.

(21) Appl. No.: 13/733,201

(22) Filed: Jan. 3, 2013

(65) Prior Publication Data

US 2014/0182427 A1 Jul. 3, 2014

(51) Int. Cl.
*B26B 29/06* (2006.01)

(52) U.S. Cl.
USPC ..... 83/13; 30/1; 30/295

(58) Field of Classification Search
USPC ..... 30/1, 295, 123, 179, 286; 83/13
See application file for complete search history.

(56) References Cited

U.S. PATENT DOCUMENTS

| | | | | | |
|---|---|---|---|---|---|
| 492,409 | A * | 2/1893 | May | 30/295 |
| 1,491,623 | A * | 4/1924 | Pitchur | 30/295 |
| 2,112,447 | A * | 3/1938 | Peterson | 606/86 R |
| 2,217,100 | A * | 10/1940 | Burns | 30/295 |
| 2,602,686 | A * | 7/1952 | Raines | 294/219 |
| 2,675,612 | A * | 4/1954 | Waterhouse | 30/1 |
| 3,094,730 | A * | 6/1963 | Schwarz | 15/218.1 |
| 4,507,804 | A * | 4/1985 | Consigny | 2/21 |
| D351,257 | S * | 10/1994 | Roberts et al. | D29/113 |
| 6,381,855 | B1 * | 5/2002 | Lin | 30/295 |
| 6,729,510 | B1 * | 5/2004 | Romanov | 223/101 |
| 6,805,031 | B1 * | 10/2004 | Stallato | 83/452 |
| 7,024,979 | B1 | 4/2006 | Lundin | |
| 7,174,599 | B2 * | 2/2007 | Stiles | 15/257.01 |
| D553,804 | S * | 10/2007 | Kaposi | D29/114 |
| 7,296,300 | B2 * | 11/2007 | Votolato | 2/21 |
| D577,155 | S * | 9/2008 | Hauser | D29/114 |
| 7,455,005 | B2 * | 11/2008 | Giessler | 83/605 |
| 8,356,382 | B2 * | 1/2013 | Zeitlin | 15/236.09 |
| 8,584,365 | B2 * | 11/2013 | Zeitlin | 30/123 |
| D707,153 | S * | 6/2014 | Meissner | D11/87 |
| 2010/0018063 | A1 * | 1/2010 | Dittly | 30/295 |
| 2012/0124843 | A1 * | 5/2012 | Reibold | 30/289 |

FOREIGN PATENT DOCUMENTS

| | | |
|---|---|---|
| WO | 01/35777 | 11/2000 |

* cited by examiner

*Primary Examiner* — Sean Michalski

(57) ABSTRACT

A method of slicing food comprises providing a cutting board, knife, food product, and a food slicing system comprising a finger guard comprising a substantially flat surface having a bottom contoured edge, a finger ring connected to a first side of the finger guard, and a knife guide attached to the finger guard at a substantially straight edge, the knife guide having an area smaller than an area of the finger guard and angled relative to the finger guard by an angle between approximately 0 and 15 degrees, the substantially straight edge having a length of at least approximately one inch and angled relative to the cutting board by an angle between approximately 15 and 60 degrees when the bottom contoured edge rests against the cutting board.

9 Claims, 3 Drawing Sheets

METHOD AND SYSTEM FOR TRAINING A USER TO CORRECTLY USE A KNIFE

BACKGROUND OF THE INVENTION

The present invention relates to a method and knife guide used to train a user to correctly use a knife, such as a chef's knife, in slicing food.

In order to properly use a chefs knife, one must keep the blade in contact with at least one knuckle of the hand holding the food. They also need to "rock the knife" in the correct mechanical motion. Most people are too afraid to do this and never learn proper technique.

During food slicing operation the object being sliced is held by one hand of the operator while the other hand is executing the necessary cutting motions with a knife to accomplish the task.

To protect the fingers of the hand holding the product from being injured by the slicing motion of the knife, unskilled operators are using finger guards.

The state of the art finger guards however do not possess the means to guide the knife in the slicing operation and therefore do not compel the user to acquire the proper technique of the knife motion as practiced by skilled kitchen personnel.

As can be seen, there is a need for solutions to these and other problems.

SUMMARY OF THE INVENTION

It is an object of the Invention to provide a simple kitchen utensil serving as a finger guard and protector during a food slicing operation.

Another object of the invention is to incorporate in the finger guard a very simple and effective knife guide that compels the operator to execute the necessary correct motions of the knife during the slicing process.

Still another purpose of the invention is, by a combination of finger and/or hand position behind the finger guard, holding the food product to be sliced, and the restrictive function of the knife guide, to teach the operator the correct motions of the knife and by continuous repetition develop safely the necessary slicing skills that in time will allow the operator to dispose of the knife guide and finger guard use and safely execute the slicing process in a professional manner.

A further object of the invention is to provide simple plastic or metal clip- on locators marking the range of the knife motion in the slicing operation and that such clip-on locators will fit any type of knife without altering its design or configuration and that such locators can be easily removed from the knife when not in use.

In one aspect of the present invention, a method of slicing food comprises: providing a cutting board, knife, and food product; providing a food slicing system comprising: a finger guard comprising a substantially flat surface having a bottom contoured edge; a finger ring connected to a first side, which may correspond to a hand side, of the finger guard; and a knife guide attached to the finger guard at a substantially straight edge, the knife guide having an area smaller than an area of the finger guard and angled relative to a second side, which may correspond to a knife side, of the finger guard by an angle between approximately 0 and 15 degrees, the substantially straight edge having a length of at least approximately one inch and angled relative to the cutting board by an angle between approximately 15 and 60 degrees when the bottom contoured edge rests against the cutting board; donning the food slicing system by placing a finger of a user into the finger ring; placing the bottom contoured edge above the food product; placing an upper edge of the knife against the substantially straight edge between the knife guide and the finger guard; and cutting the food product with the knife.

In another aspect, the food slicing system further comprises an integrated knife sharpener. In another aspect, the food slicing system further comprises a magnet.

In another aspect, the method further comprises providing locators connected to the knife configured to identify starting and finishing points for a knife cut. In another aspect, the locators comprise adjustable clips. In another aspect, the locators comprise at least one of grooves and markings in the knife. In another aspect, the bottom contoured edge is substantially concave. In another aspect, the substantially straight edge is angled relative to the cutting board by an angle between approximately 30 and 50 degrees when the bottom contoured edge rests against the cutting board.

In another aspect, a food slicing system comprises: a finger guard comprising a substantially flat surface having a bottom contoured edge; a finger ring connected to a first side of the finger guard; and a knife guide attached to the finger guard at a substantially straight edge, the knife guide having an area smaller than an area of the finger guard and angled relative to a second side of the finger guard by an angle between approximately 0 and 15 degrees, the substantially straight edge having a length of at least approximately one inch and angled relative to a cutting board by an angle between approximately 15 and 60 degrees when the bottom contoured edge rests against the cutting board.

These and other features, aspects and advantages of the present invention will become better understood with reference to the following drawings, description and claims.

DETAILED DESCRIPTION OF THE INVENTION

Figure 1:
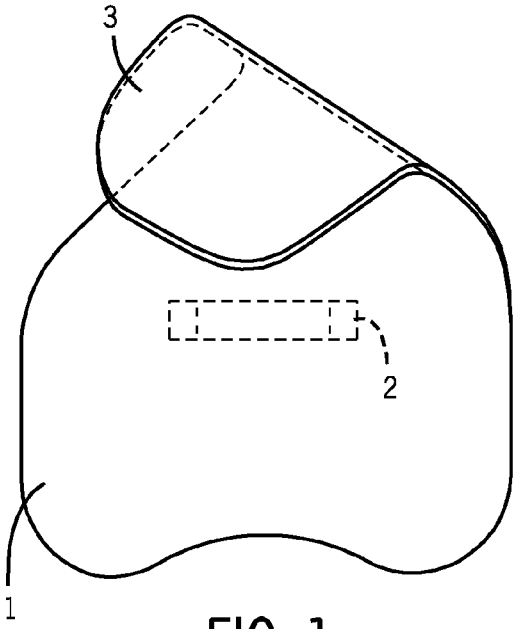
FIG. 1: is a frontal, knife side view for a right handed user.

The following detailed description is of the best currently contemplated modes of carrying out exemplary embodiments of the invention. The description is not to be taken in a limiting sense, but is made merely for the purpose of illustrating the general principles of the invention.

Referring to the drawings, the following reference numbers refer to shown elements:

1: is the finger guard.

2: is the finger ring.

3: is the integral knife guide.

4: is the knife.

5: is the clip-on locator.

6: is the clip-on locator.

7: is the cutting board.

8: is the food product.

9: is the bottom contoured edge.

20: is the system according to one embodiment of the present invention.

The integral guide according to the present invention is a training tool as well as a guard. The present invention acts as a guard to protect the knuckle(s) of the "food holding hand"

but more importantly is a mechanical guide which forces the knife to make the correct mechanical motion to properly use a chefs knife. It is a mechanical invention as well as a training technique.

This invention is an improvement on what currently exists. No other guards incorporate a guide. None will guide the blade; they only protect the knuckles with no training technique.

How The Invention Works:

The invention is worn on the index or possibly the middle finger of the food holding hand. The one-piece design functions as a knuckle guard with an integral guide which consists of a flap of the material which automatically assists the user to use the knife in proper technique.

How To Make The Invention:

This item may be made of injection molded plastic of any type known in the art, or a metal (such as stainless steel) of any type known in the art. Additional options could include: Some type of locators which would alert the user on which point the knife should start moving back into the original position. Those locators could be some sort of removable clips which attach to the knife, or could be decals or other purely visual aids. Also, a knife could be sold with the invention which has been marked, grooved, cut, or modified in some way to work in concert with the guide invention. The invention may be made in both right and left-handed models. Another option is to have the invention contain an integral knife sharpener. The item could also have a steel or other magnetic metal inside the device making it suitable to be mounted on a magnetic knife rack. Or it could have a magnet inside making it able to stick to the fridge or other metal object.

How To Use The Invention:

A person uses the device by wearing it on their food holding hand by placing their index or middle finger through the finger ring. The food slides underneath the curve in the bottom of the device as the person moves their hand backwards, essentially pushing the food under in order to be cut. The guard portion 1 of the device protects the fingers and the guide portion 3 assures proper technique. This device can be used as a training tool and technique and could then be discarded when the user achieves proper training and can opt to not use the device.

Referring now to the drawings, a finger guard 1 used as finger protection during slicing of food products has an integral knife guide 3 for the purpose of teaching the user a proper method of slicing or cutting food products as practiced by skilled kitchen personnel at the same time protecting the fingers of the hand holding the food product being sliced.

The knife 4 used in this operation has two clip-on locators 5, 6 marking the front and rear range of the knife motion with respect to the product being sliced. The shape and arrangement of the finger guard's knife guide 3 in conjunction with the knife clip-on locators 5, 6 allow for the proper motion of the knife in the slicing process.

The described Finger Guard with integral Knife Guide in conjunction with knife clip-on locators, the system 20 according to the present invention, remedy drawbacks with the prior art and guide the user in proper slicing motions of the knife helping the operator in time to achieve the proper slicing skills.

FIG. 1 illustrates the finger guard 1 in a frontal view facing the right hand holding a knife 4, as designed for a right handed operator, with the knife guide 3 which is a folded over leaf extension of the guard 1 and positioned at an angle upwards toward the user allowing thus for controlled upwards movement of the knife during the food slicing process. A finger ring 2 is positioned behind the face of the finger guard 1. The ring 2 may be adjustable in size and/or location. The system 20 may comprise any hard material known, such as metal, plastic, ceramic, composite materials, etc.

Figure 2:
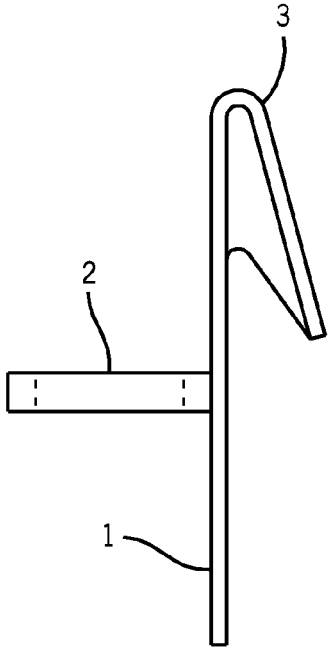
FIG. 2: is a side view of FIG. 1.

The positions of the finger ring 2 and the knife guide 3 in relation to the finger guard 1 are shown in FIG. 2 which is a side view of invention shown in FIG. 1.

The right handed user will wear the finger guard 1 on his left hand by inserting his index or middle finger in to the ring 2, grasp the food object such as a cucumber, carrot or onion, and holding the knife in his right hand bring its blade in contact with the finger guard 1 within the space of the knife guide 3 and commence the slicing operation guided by the shape and position of the knife guide 3 while his fingers of the left hand are protected behind the finger guard 1.

The shape of the finger guard 1 is optimized for the ergonomics of the hand, food shape to be sliced and the slicing motion of the knife.

It is envisioned that the finger guard 1 with the integral knife guide 3 and finger ring 2 are executed using materials that are dishwasher safe such as stainless steel or high temperature non porous plastics.

Figure 4:
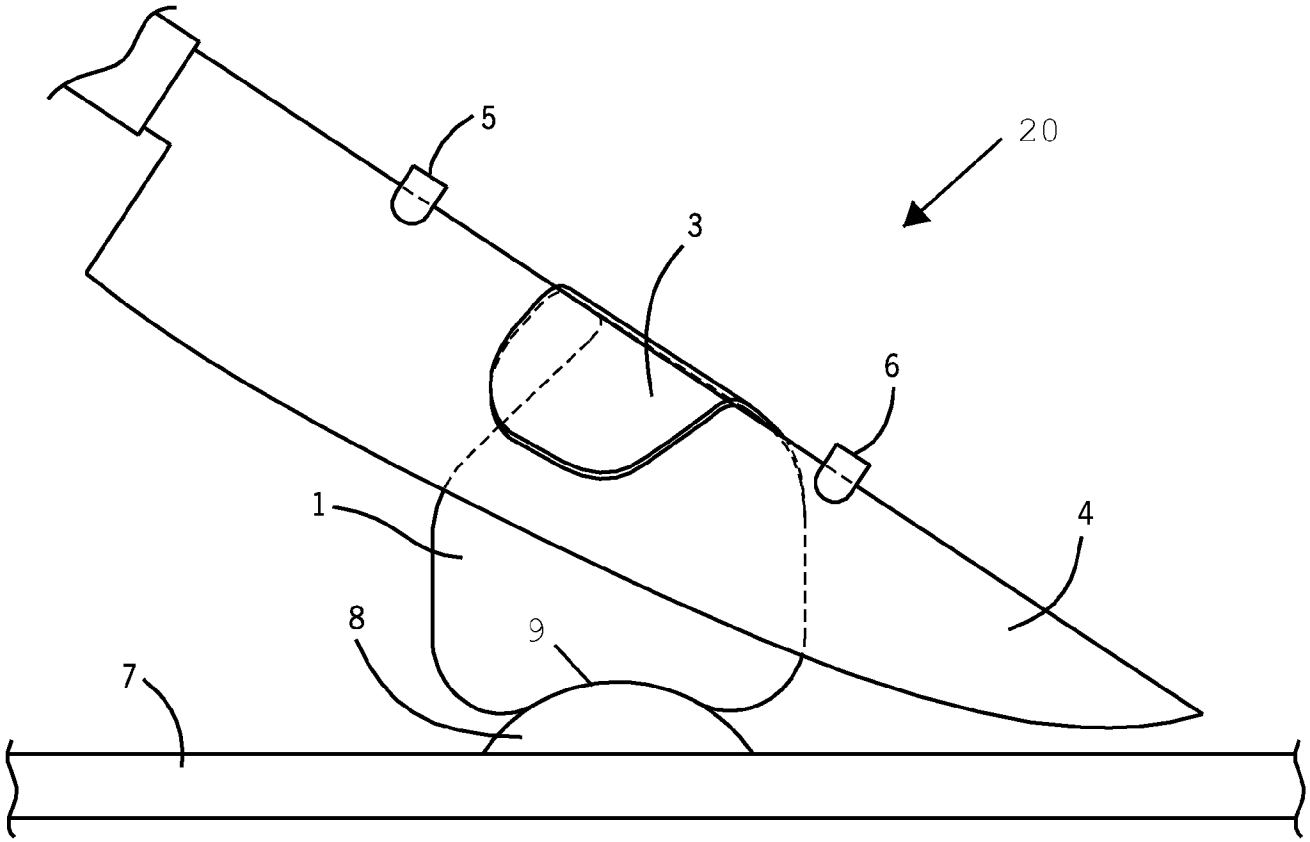
FIG. 4: is an assembly view of the culinary knife training tool engaging the knife.

The described slicing application of the Invention are better illustrated in FIG. 4 which shows interactive position of the finger guard 1, knife guide 3, knife 4 with attached clip-on locators 5, 6 in relation to the cutting board 7 and the food object 8 to be sliced. This arrangement is illustrated for a right-handed operator and depicts a starting position of the knife in the slicing operation.

The rocking and cutting motion of the knife 4 in its forward and backward motion is further assisted as a visual and tactile aid by the clip-on locators 5, 6. The clip-on locators 5 and 6 may be designed as springy self gripping elements manufactured from stainless steel or dishwasher safe plastic.

Figure 3:
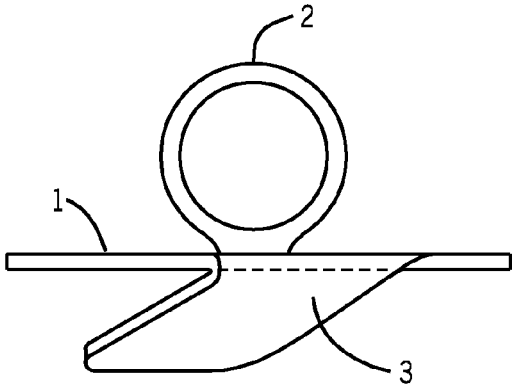
FIG. 3: is a top view of FIG. 1.
Figure 5:
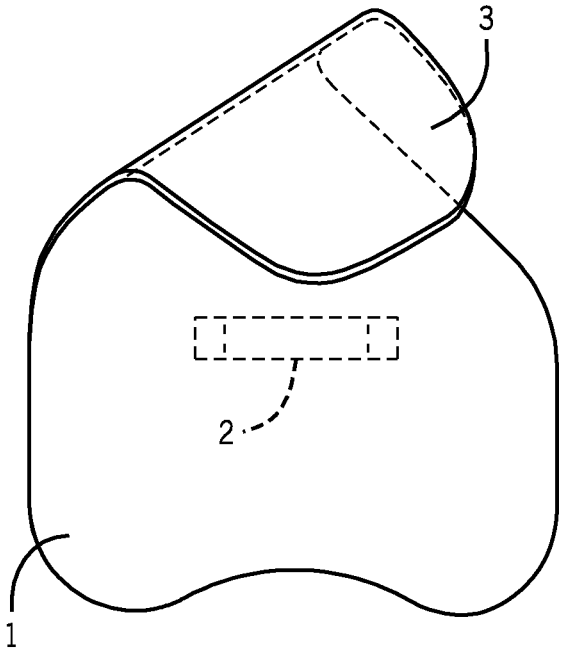
FIG. 5: is a frontal, knife side view for a left handed user.
Figure 6:
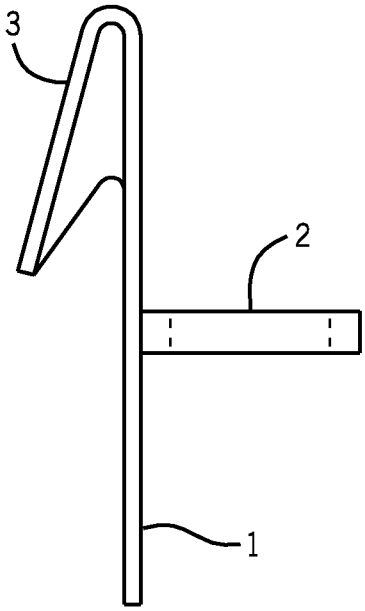
FIG. 6: is a side view of FIG. 5.
Figure 7:
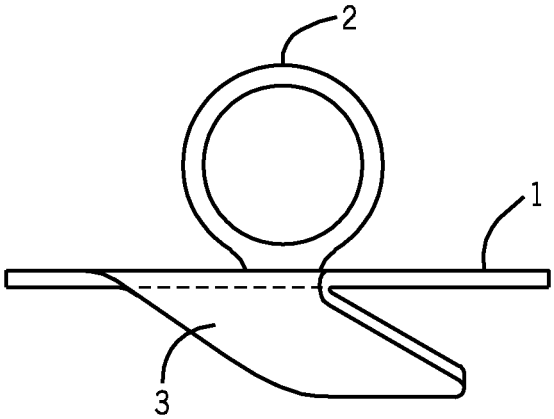
FIG. 7: is a top view of FIG. 5.

FIGS. 5, 6 and 7 are depicting the previously described Invention shown in FIGS. 1, 2 and 3 but executed for a left-handed operator. Accordingly, for a left-handed user, the interactive position of the finger guard 1, knife 4 over the cutting board 7 and food part 8, will be a mirror image of the system 20 shown in FIG. 4.

In other embodiments, the device could be made in either multiple heights and multiple angles of the guide, as well as being made to be adjustable for height and angle in order to accommodate other knife motions such as chopping or cutting with a "non-rocking" method.

For example, the method may include providing a variety of food slicing systems having different sizes so as to allow for cutting of different foods or different sized hands. The food slicing systems may have substantially straight edges angled relative to the cutting board by differing angles; e.g., one system may have an angle of 15 degrees, another at 30 degrees, another at 45 degrees, etc., to allow for different sized knives and cutting methods.

Alternatively or in addition, the method may include providing a single food slicing system having adjustable features, such as an adjustable height or an adjustable knife guide so that the substantially straight edge has an adjustable angle, and so forth.

It should be understood, of course, that the foregoing relates to exemplary embodiments of the invention and that modifications may be made without departing from the spirit and scope of the invention.

What is claimed is:

1. A method of slicing food comprising:

providing a cutting board, knife, and food product;

providing a food slicing system comprising:

a finger guard comprising a substantially flat surface having a bottom contoured edge;

a finger ring connected to a first side of the finger guard; and a knife guide attached to the finger guard at a substantially straight edge, the knife guide having an area smaller than an area of the finger guard and angled relative to a second side of the finger guard by an angle between approximately 0 and 15 degrees, the substantially straight edge having a length of at least approximately one inch and angled relative to the cutting board by an angle between approximately 15 and 60 degrees when the bottom contoured edge rests against the cutting board;

donning the food slicing system by placing a finger of a user into the finger ring;

placing the bottom contoured edge above the food product;

placing an upper edge of the knife against the substantially straight edge between the knife guide and the finger guard; and cutting the food product with the knife.

2. The method as claimed in claim 1, wherein the food slicing system further comprises an integrated knife sharpener.

3. The method as claimed in claim 1, wherein the food slicing system further comprises a magnet.

4. The method as claimed in claim 1, further comprising providing locators connected to the knife configured to identify starting and finishing points for a knife cut.

5. The method as claimed in claim 4, wherein the locators comprise adjustable clips.

6. The method as claimed in claim 4, wherein the locators comprise at least one of grooves and markings in the knife.

7. The method as claimed in claim 1, wherein the bottom contoured edge is substantially concave.

8. The method as claimed in claim 1, wherein the substantially straight edge is angled relative to the cutting board by an angle between approximately 30 and 50 degrees when the bottom contoured edge rests against the cutting board.

9. A food slicing system comprising:

a finger guard comprising a substantially flat surface having a bottom contoured edge;

a finger ring connected to a first side of the finger guard; and a knife guide attached to the finger guard at a substantially straight edge, the knife guide having an area smaller than an area of the finger guard and angled relative to a second side of the finger guard by an angle between approximately 0 and 15 degrees, the substantially straight edge having a length of at least approximately one inch and angled relative to a cutting board by an angle between approximately 15 and 60 degrees when the bottom contoured edge rests against the cutting board.

* * * * *